US009138617B2

(12) United States Patent
Duboy

(10) Patent No.: US 9,138,617 B2
(45) Date of Patent: Sep. 22, 2015

(54) DIVERS PROPULSION SYSTEM

(71) Applicant: Gustavo Duboy, Miami Lakes, FL (US)

(72) Inventor: Gustavo Duboy, Miami Lakes, FL (US)

( * ) Notice: Subject to any disclaimer, the term of this patent is extended or adjusted under 35 U.S.C. 154(b) by 0 days.

(21) Appl. No.: 14/057,138

(22) Filed: Oct. 18, 2013

(65) Prior Publication Data

US 2015/0111445 A1 Apr. 23, 2015

(51) Int. Cl.

| | |
|---|---|
| ***A63B 35/12*** | (2006.01) |
| ***B63C 11/46*** | (2006.01) |
| ***B63C 11/00*** | (2006.01) |

(52) U.S. Cl.

CPC ..... *A63B 35/12* (2013.01); *B63C 11/00* (2013.01); *B63C 11/46* (2013.01)

(58) Field of Classification Search

CPC ..... A63B 35/00; A63B 35/12; B63C 11/46
USPC ..... 114/315, 333, 338; 405/185, 186, 187; 440/6

See application file for complete search history.

(56) References Cited

U.S. PATENT DOCUMENTS

| | | | | |
|---|---|---|---|---|
| 3,329,118 | A * | 7/1967 | Strader | 114/315 |
| 3,995,578 | A * | 12/1976 | McCullough | 440/6 |
| 4,467,742 | A * | 8/1984 | Duboy | 114/315 |
| 7,270,074 | B2 * | 9/2007 | Pradetto et al. | 114/315 |
| 7,654,215 | B2 * | 2/2010 | Vitale | 114/315 |

* cited by examiner

*Primary Examiner* — Lars A Olson
(74) *Attorney, Agent, or Firm* — Patent CEO; Phillip Vales

(57) ABSTRACT

A scuba tank accessory unit improves the diver experience by providing a streamlined diving unit for a back mounted diving device. The diving unit has a propulsion unit having a space for mounting a battery powered electric motor, armature extending out one end of the propulsion unit and further attached to a propellor. A battery pack is contained in a housing unit located either concentrically about the electric motor or atop it such that the electric motor extends slightly therein with a depression or cavity at the bottom of the housing unit.

4 Claims, 6 Drawing Sheets

DIVERS PROPULSION SYSTEM

FIELD OF THE INVENTION

The present invention relates to a battery powered propulsion unit for an underwater breathing apparatus having a tank worn on the diver's back. More specifically, the invention relates to a more perfect arrangement of the battery units within a back mounted propulsion unit.

BACKGROUND OF THE INVENTION

Underwater motion has always been a challenge to fisherman, deep sea explorers and hobbyists. The various factors unique to the ocean environment such as salinity, pressure, density and temperature and more present obstacles to be overcome when swimming under the ocean. Because of the aforementioned, scuba equipment designers must offer solutions that can meet the increased demands for performance, portability and streamlining of the propulsion unit.

Prior propulsion units such as that found in U.S. Pat. No. 4,467,742 awarded to Gustavo Duboy (herein incorporated by reference) have provided a novel battery system located on opposite sides of a belt such as shown in FIG. 1. In particular, the '742 patent teaches a battery-powered propulsion unit for a diver's tank has an electric motor driving a propellor and mounted in a housing which is attachable to the lower end of the tank. A belt worn on the diver's waist carries first and second groups of battery holders, each made up of separable halves which are releasably attached to the belt on opposite sides of its buckle. The buckle carries a control switch for the motor which is connected by flexible cables to the motor and to the first and second groups of battery holders.

FIG. 1A presents a prior art solution having a scuba tank harness mounted on a propulsion unit mounted to the back of an individual having a waist mounted battery holder unit. FIG. 1B illustrates a closeup of a cross section of the scuba tank harness, propulsion unit, protective shroud covering the propulsion unit and the electric motor effecting the forwards motion.

This prior art solution has many novelties that were good for the time it was created. However, a failing of this prior art system is that the battery packs are located on opposite sides of the user's waist; another is that the bulky non-streamlined nature of the battery holders create a reduction in fluid flow. These two realities of the prior art system combine to create a drag effect when the propulsion unit is engaged. Thus, there needs to be some solution to overcome the problems found in the prior art.

Accordingly, there remains a need in the art for providing a battery powered propulsion unit that does not suffer from a bulky ungainly battery holder unit.

SUMMARY OF THE INVENTION

The present invention overcomes the deficiencies of the known art and the problems that remain unsolved by providing a system.

In accordance with one embodiment a diver's tank apparatus comprising:

a propulsion unit having a space therein for positioning of
an electric motor with
an armature connected thereto and
a battery pack arranged about the periphery of the electric motor.

In another aspect, a plurality of batteries each arranged between a pair of battery holders and arranged in series to create a predetermined voltage.

In another embodiment, a propulsion unit comprising:

a propulsion unit housing
an electric motor connected to
a propellor armature threaded through an opening in the propulsion unit housing and
a battery holder unit disposed concentrically about the electric motor.

In another aspect, wherein the battery holder unit further comprises an annular holder device.

In another embodiment, a diver propulsion unit comprising:

a motor having
a propellor and its armature attached thereto and to
a battery housing wherein the motor is disposed underneath the housing and a head of the motor extends into the housing through an opening in the housing.

In another aspect, a streamlined propulsion unit attached to the battery housing, the motor and the propellor armature.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which:

FIG. 4A illustrates a top view of a 40 cell battery convention of another embodiment.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each individual figure. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
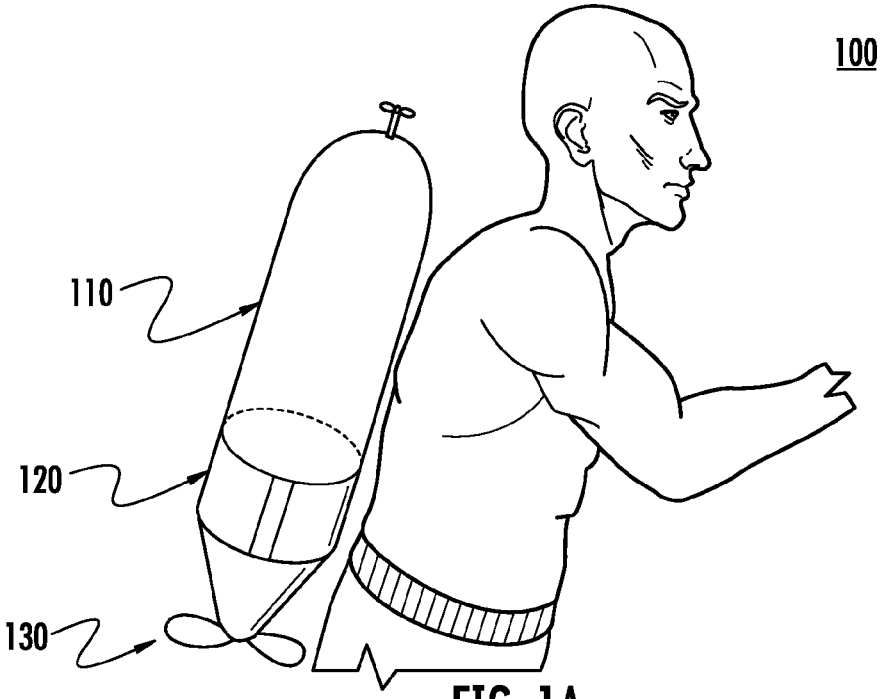
FIG. 1A (PRIOR ART)
FIG. 1A presents a prior art solution having a scuba tank harness mounted on a propulsion unit mounted to the back of an individual having a waist mounted battery holder unit.
Figure 1B:
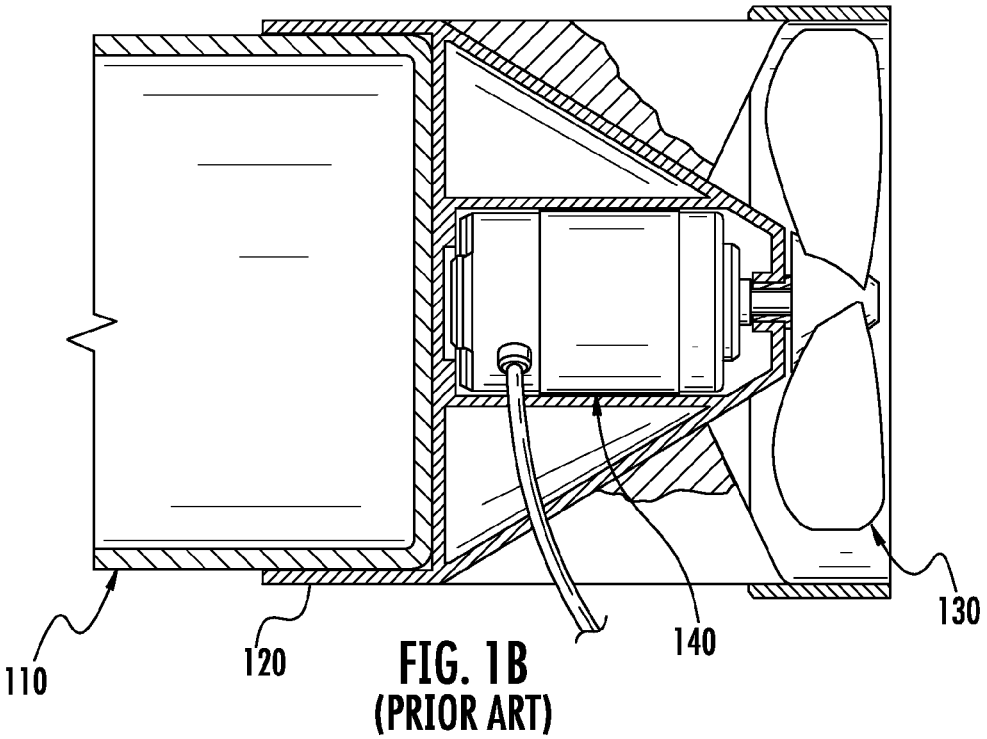
FIG. 1B (PRIOR ART)
FIG. 1B illustrates a closeup of a cross section of the scuba tank harness, propulsion unit, protective shroud covering the propulsion unit and the electric motor effecting the forwards motion.
Figure 2A:
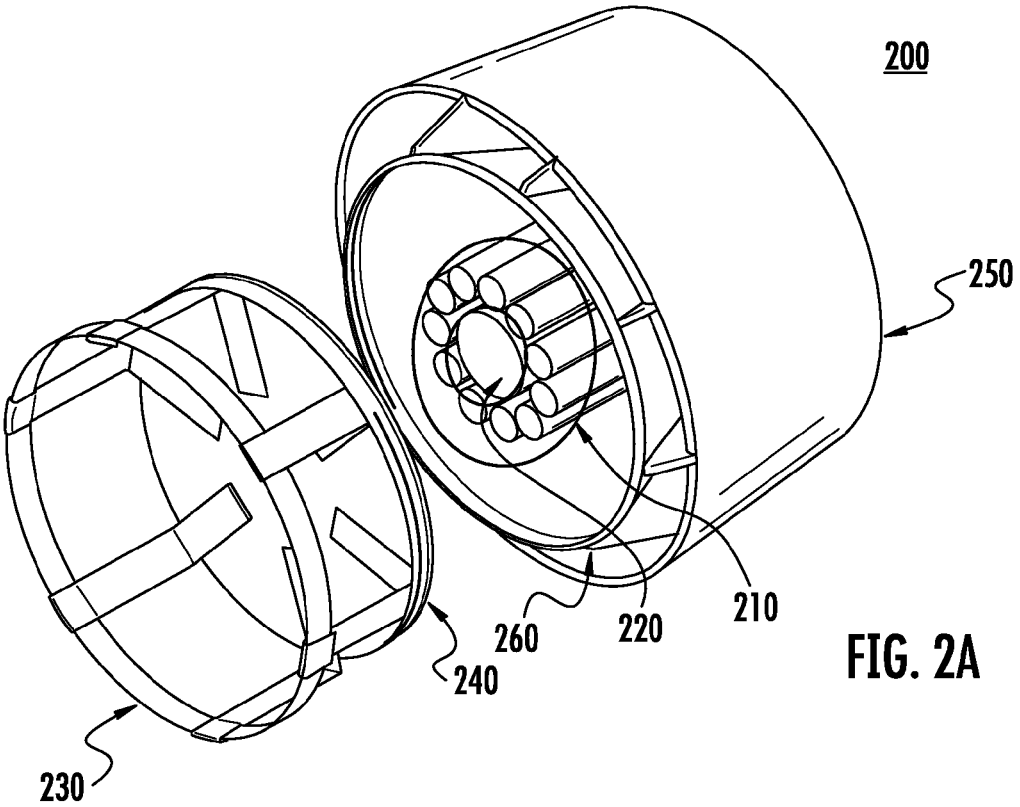
FIG. 2A presents an isometric view of a scuba tank harness or holder being disengaged from the battery propulsion propellor unit.
Figure 2B:
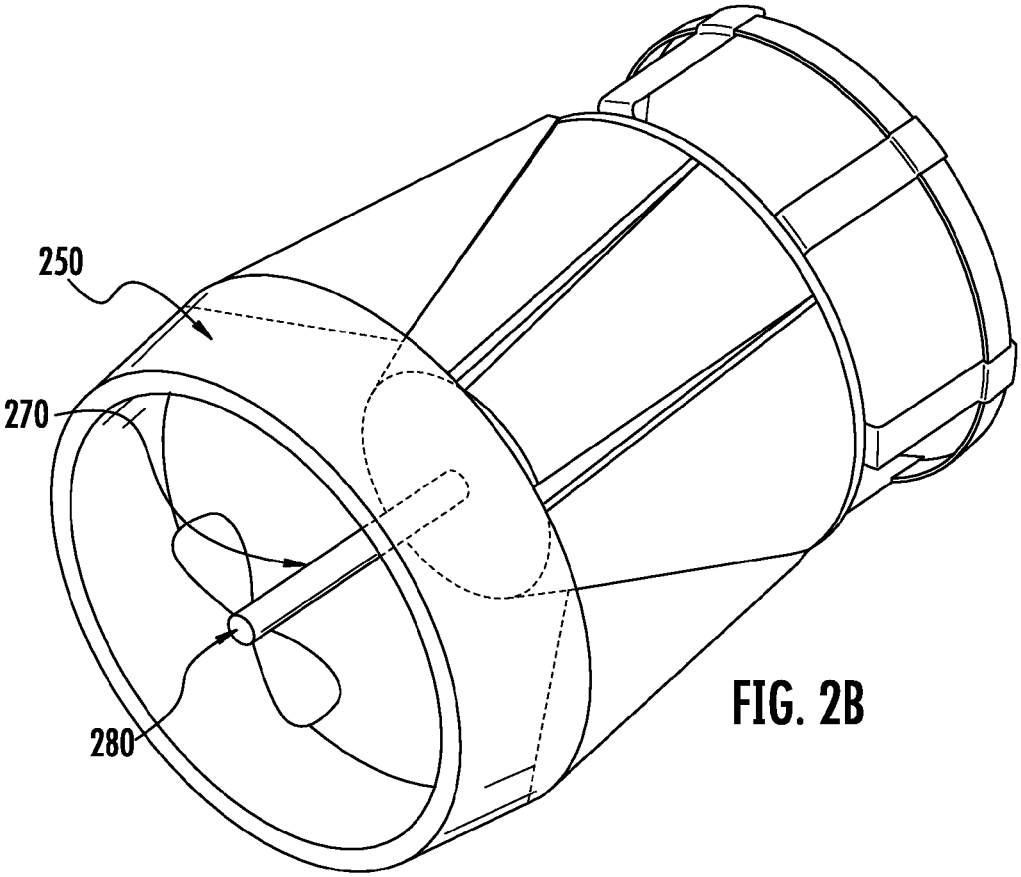
FIG. 2B presents an isometric view of the rear portion of the battery propulsion propellor unit showing the propellor protruding out the rear of the unit.

A Diver's Propulsion System is shown beginning on FIG. 2A. This figure presents an isometric view 200 of a scuba tank harness or holder 230 being disengaged from the battery propulsion propellor unit. A scuba tank holder 230 has a groove or thread 240 that matches a corresponding thread or groove 260 on the inner lip of a propulsion unit 250. These two cooperate to provide a water tight seal when the two corresponding threads or grooves 240, 260 are engaged together. Thus, the contents of the propulsion unit 250 including a cylindrical holder 210 for a battery pack, electric motor housing 220 and electrical connections can be protected from water seepage. The electric motor housing 220 has a propellor 280 attached thereto through the use of an armature 270. FIG. 2B presents an isometric view of the rear portion of the battery propulsion propellor unit showing the propellor 280 protruding out the rear of the unit attached to the armature 270. The location where the armature extends into and out of the back of the propulsion unit 250 are sealed with appropriate water tight rubber seals or similar materials.

Figure 3A:
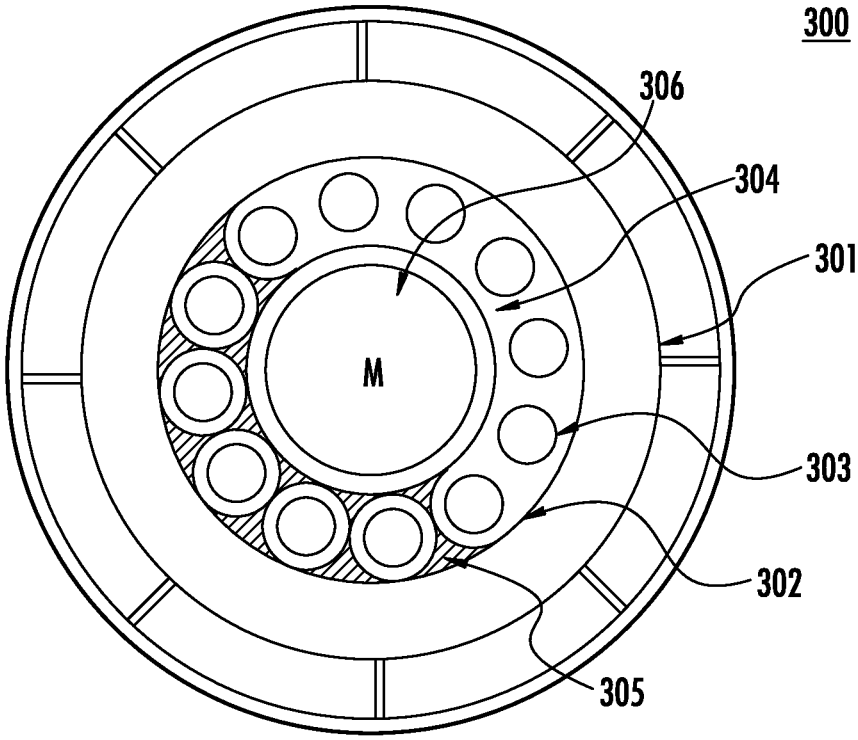
FIG. 3A presents a top view of the propulsion unit showing the battery unit of the present embodiment.

As shown in FIG. 3A, a conical propulsion unit 301 has a cylindrical battery holder 210 concentrically disposed about the electrical motor M 306 in the figure. Appropriate physical support for this cylindrical battery holder 210 is provided by having its external surface integrated with the inner walls of the conical propulsion unit 301 as shown; in this embodiment, the bottom edge of the cylindrical battery holder 210 is integrated with the inner surface of the conical propulsion unit 301. The battery pack holder 210 includes a number of watertight battery holders each holding a rechargeable battery 303 of predetermined voltage. The cylindrical battery holder 210 is shaped in the form of an annulus between an inner 304 and outer walls 302 with a plurality of cylindrical recesses for snugly receiving the corresponding batteries 303 arranged in alternating positive negative fashion.

Figure 3B:
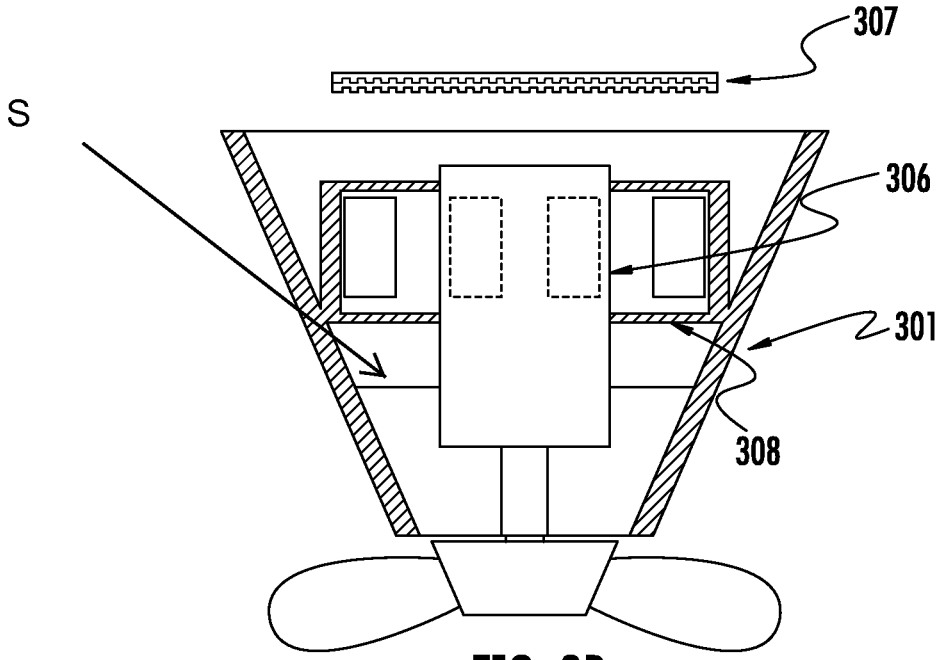
FIG. 3B illustrates a section view through the propulsion unit.

This arrangement facilitates electrical connection between adjacent contacts on the top portion of the bottom surface of the battery holder 210 and between adjacent contacts on the underside of sealing annulus 307 shown in FIG. 3B. This electrical connection scheme is described further below with respect to FIG. 3D-E. Finally, there are plastic protrusions 305 that are integrated with the battery holder 210 that create multiple cylindrical cavities or slots for proper positioning of the batteries therein; these protrusions extend from the inside of the inner wall 304 to the inside of the outer wall 302.

FIG. 3B illustrates a section view through the propulsion unit 301. This view better illustrates how the batteries 303 are arranged about the motor 306. The bottom 308 of the cylindrical holder unit 210 is integrated with the inner surface of the conical propulsion unit 301 where the bottom 308 meets the perpendicular circular material of the cylindrical holder unit 210; in other words, the circumferential material forming the external boundary of the annulus holder. This view also shows the sealing annulus 307 of the cylindrical holder unit 210 having threads along its outer edge corresponding to the inner lip of surface 302 and it is understood that the inner circular edge of the annulus 307 has threads that correspond with similar threads found on the inner lip of surface 304; these threads have corresponding threads along the inner lips 302, 304 so as to effect a good seal with the holder unit thereof. Finally, this figure shows plastic or metallic supports S from the external surface of the electrical motor made from protrusions extending from the inner surface of the propulsion unit to the external surface of the motor M.

Figure 3C:
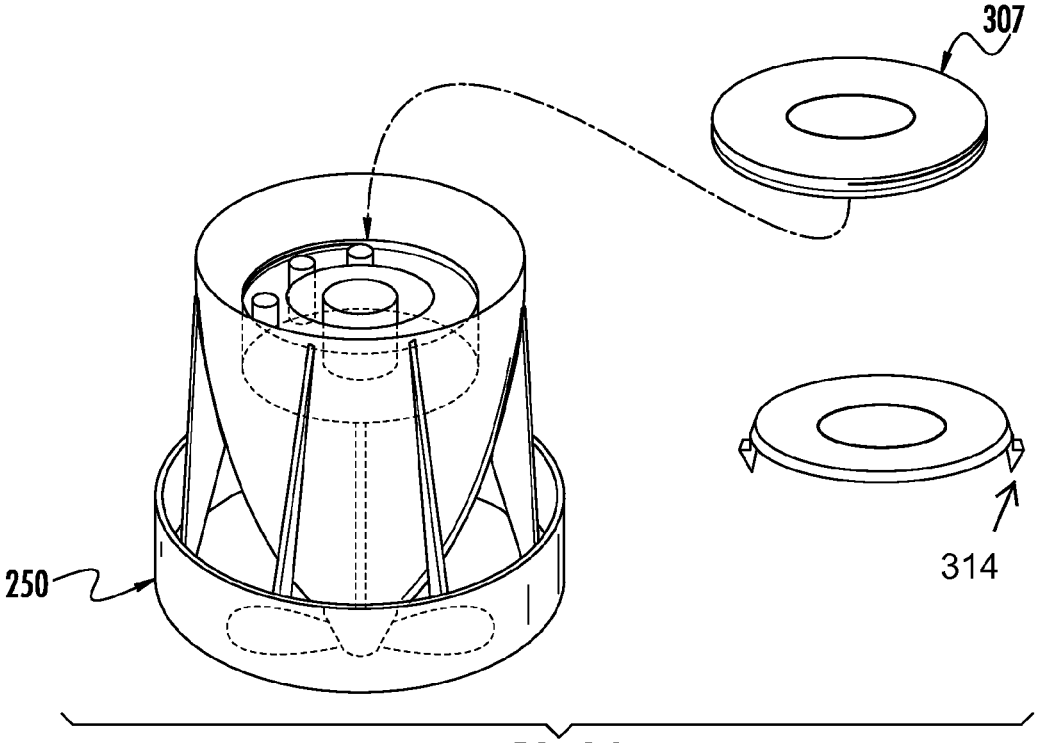
FIG. 3C is an isometric view of a propulsion unit.

FIG. 3C is an isometric view of a propulsion unit having a cylindrical battery holder unit 210 therein. Two types of seals for the battery holder unit 210 are described herein; a first having an screw-on annular sealing device and a second having an arrowhead connection arrangement. In a first embodiment, the rotational engagement between the sealing annulus 307 and the top of battery holder unit 210 acts to make a second watertight seal for protection of the batteries from water seepage. An alternative solution to the sealing of this battery holder unit 210 is to have a protrusion 314 extending from one side of the sealing annulus 307 as shown; this is user inserted into a slot (not shown) found along an inner edge of the larger radial circle at the top of the annular holder unit 210. Thus, the engagement arrowhead 314 acts to secure the sealing annulus onto the top of the battery holder unit. The arrowhead 314 is inserted into a corresponding loop or slot extending from the inner lip of the larger radial surface of the battery holder unit 210. This embodiment is completed by providing a water tight seal with the addition of appropriate rubber strips to help seal the contact points and edges as needed; the other embodiment using grooves also adds a rubber seal(s) as needed.

Figure 3D:
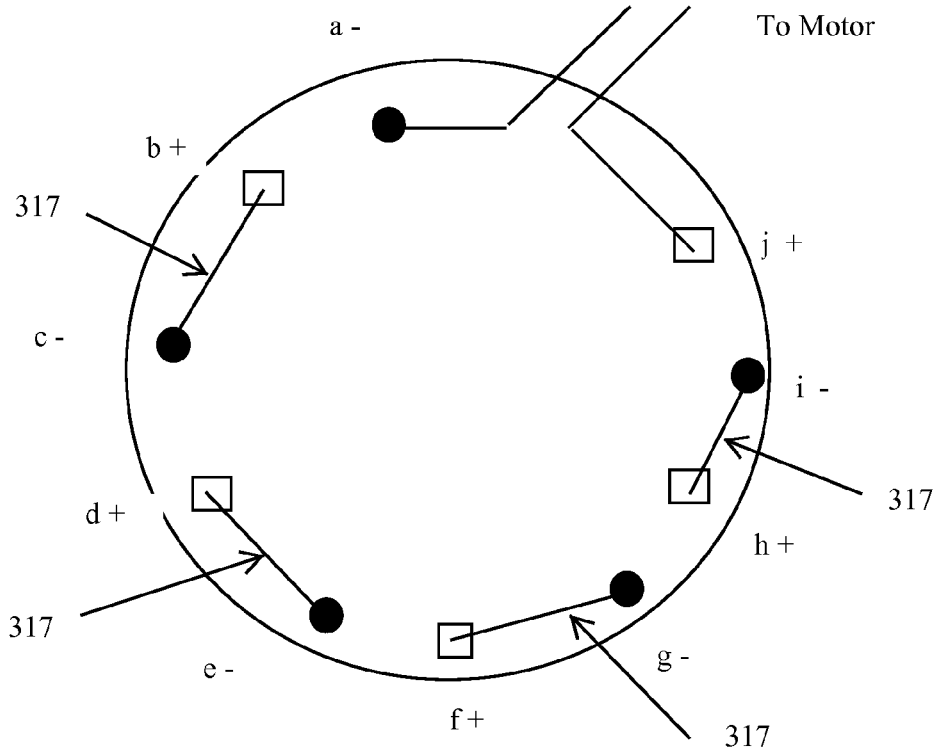
FIG. 3D illustrates the electrical connections made at the bottom inner portion of the battery holder.

FIG. 3D illustrates the electrical connections made at the bottom inner portion of the battery holder. At the bottom of the battery holder unit 210 is an inner portion 308 also in the shape of an annulus. This inner portion 308 has alternating metallic spring and flat contacts 316– and 316+ embedded in slots as appropriate. Additionally, there are electrical wires 315 extending out through a hole in the side of the battery holder unit that is rubber sealed; thus, the wires are in wired contact with the motor in the center of the propulsion unit and actuate motion of the system. The spring and flat contacts 316– and 316+ are arranged about the top inner side of the battery holder 210 in such a fashion that they form a circuit with the bottom of annulus sealing lid 307. The contacts are numbered a, b, c, d, e, f, g, h, i, j on the top of the inner portion 308 and a', b', c', d', e', f', g', h', i', j' on the bottom of sealing annulus lid 307. The connections alternate according to the needs of the circuit.

Figure 3E:
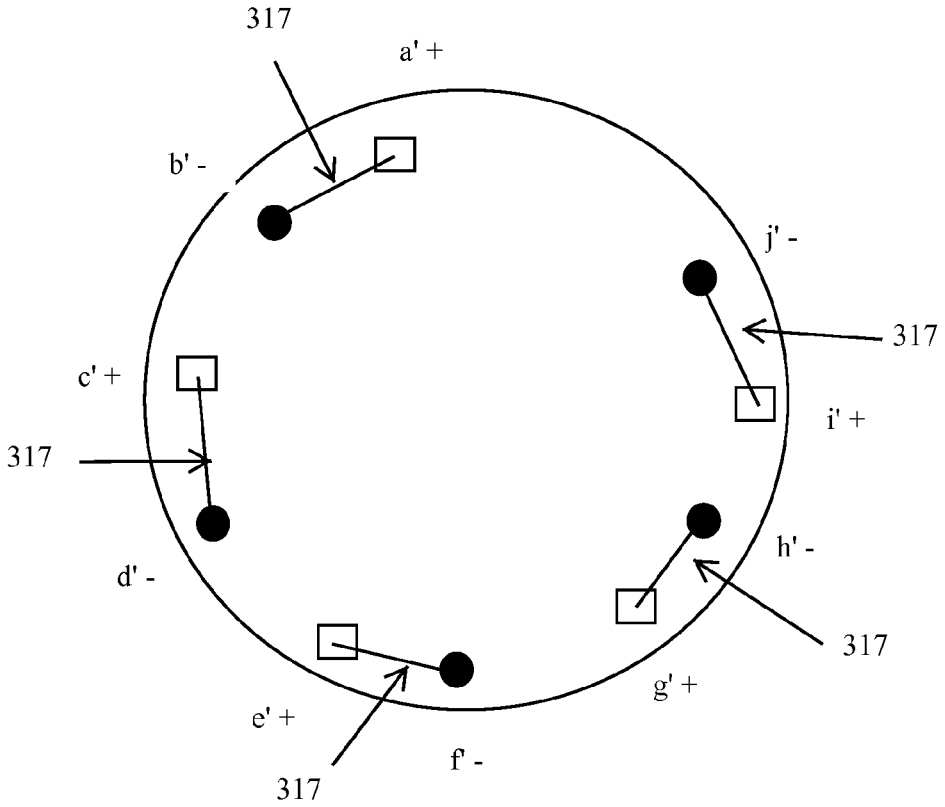
FIG. 3E illustrates the electrical connections made at the bottom portion of a sealing lid for the battery holder.

FIG. 3E illustrates the electrical connections made at the underside or bottom portion of a sealing lid 307 for the battery holder. The annular sealing lid 307 has alternating metallic spring and flat contacts 316 embedded in slots as appropriate. The insertion of the batteries in an alternating fashion up then down then up and so on each in a single cavity of the battery holder unit 210 permits the series connection of the batteries to provide a working voltage for the motor. Thus the negative portion of a battery is in contact with a spring 316– and its positive portion is in contact with a flat metallic plate 316+. Finally, a wired connection 317 is made between adjacent contacts as appropriate to make the series connection.

The battery holder unit 210, sealing annulus 307 and battery cavity protrusions 305 are made from a suitable plastic or similar materials. The electrical contacts are made from suitable metallic materials.

FIG. 4A illustrates a top view of a 40 cell battery convention of another embodiment.

Figure 4B:
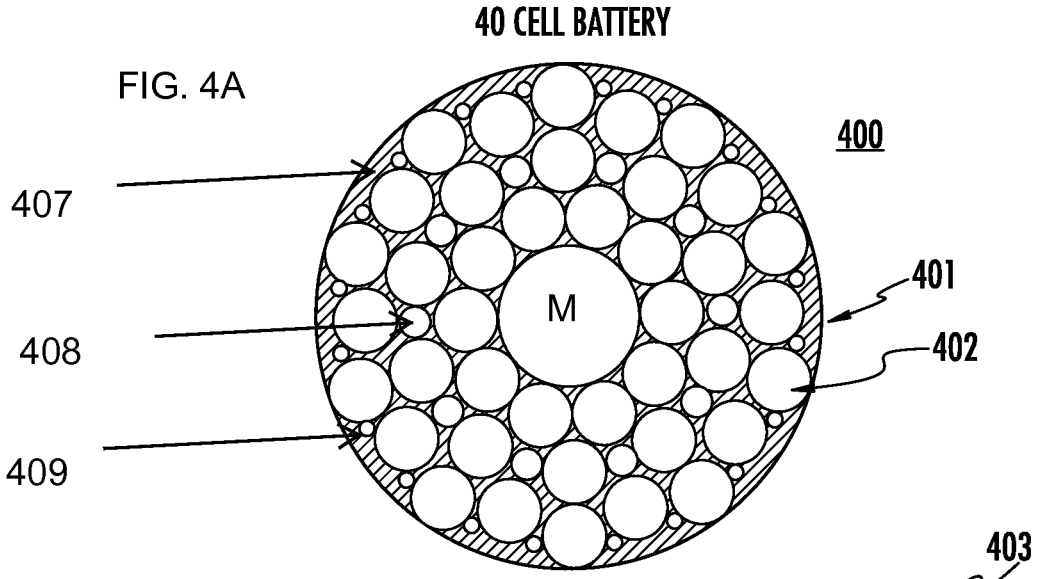
FIG. 4B illustrates a section view of the propulsion unit, propulsion unit shroud, 40 cell battery container located above an electric motor.
Figure 4B:
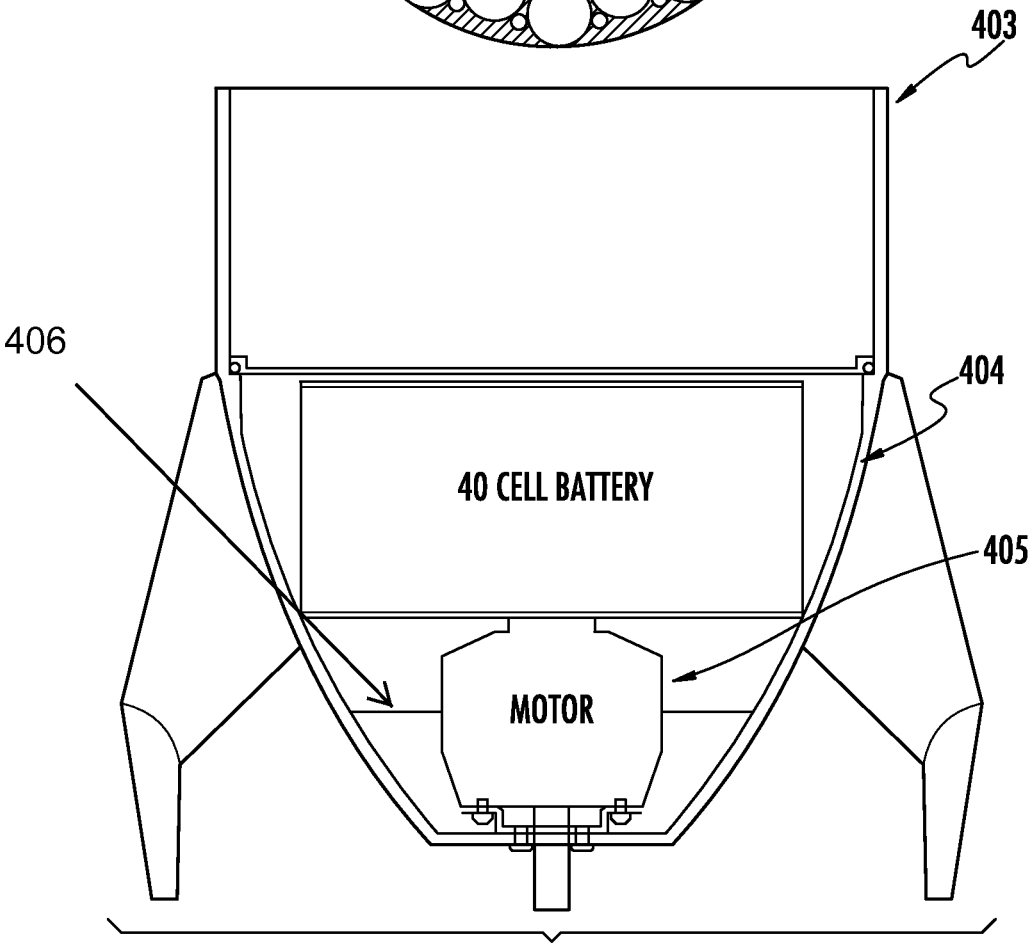

This embodiment 400 shows a cylindrical container 401 having 40 batteries 402 along with their cylindrical subspaces. Filler material 407 acts as spacing material between the different battery compartments and their inserted batteries. Sub spacers 408 and 409 are spaces formed to lessen the amount of weight of the holder 401. FIG. 4B illustrates a section view of the propulsion unit, propulsion unit shroud, 40 cell battery container located above an electric motor. The motor M sits underneath the battery holder cell 401 and extends slightly therein to provide physical support to the holder unit. Again the holder unit 401 has integral support from the side inner walls of conical propulsion unit 404. The motor is further supported by supports 406 that extend from the inner walls of propulsion unit 404 towards the surface of the motor M. The motor 405 armature extends out the bottom of the conical propulsion unit 404 thereby providing power to a propellor (not shown). Appropriate seals for the propellor armature and other components are understood in this and the other embodiment.

Thus, the embodiment taught herein have shown how to make a battery powered propulsion unit that overcomes the prior art problems of streamlining the bulky ungainly battery holder unit as the battery pack is now located within the confines of the propulsion unit instead of external to the user's body.

What is claimed is:

1. A diver's tank apparatus comprising:

a propulsion unit having a space therein for positioning of an electric motor with an armature connected thereto and a battery pack arranged about the periphery of the electric motor wherein the battery pack further comprises:

a plurality of batteries each arranged between a pair of battery holders and arranged in series to create a predetermined voltage.

2. A propulsion unit comprising:

a propulsion unit housing an electric motor connected to a propellor armature threaded through an opening in the propulsion unit housing and a battery holder unit disposed concentrically about the electric motor wherein the battery holder unit further comprises an annular holder device.

3. A diver propulsion unit comprising:

a motor having a propellor and its armature attached thereto and to a battery housing wherein the motor is disposed underneath the housing and a head of the motor extends into the housing through an opening in the housing.

4. The diver propulsion unit of claim 3, further comprising:

a streamlined propulsion unit attached to the battery housing, the motor and the propellor armature.

* * * * *